United States Patent [19]

Gant et al.

[11] Patent Number: 4,729,193

[45] Date of Patent: Mar. 8, 1988

[54] CUTTING DISK MOUNTING ASSEMBLY

[76] Inventors: Eugene Gant, 4605 Merrydale Ave., Dayton, Ohio 45421; Richard Spangler, 3924 Cloverdale Rd., Medway, Ohio 45341

[21] Appl. No.: 944,010

[22] Filed: Dec. 22, 1986

[51] Int. Cl.[4] ..... B24B 41/04

[52] U.S. Cl. ..... 51/168; 51/209 R; 83/666; 83/676; 409/231

[58] Field of Search ..... 51/168, 170 R, 170 T, 51/170 PT, 209 R; 83/666, 676; 409/231, 232, 234

[56] References Cited

U.S. PATENT DOCUMENTS

| | | | |
|---|---|---|---|
| 566,883 | 9/1896 | Alden et al. . | |
| 927,145 | 7/1909 | Hyde | 51/168 |
| 1,756,259 | 4/1930 | Perks . | |
| 1,792,083 | 12/1928 | Gammeter . | |
| 2,540,793 | 4/1950 | Metzger . | |
| 3,036,412 | 7/1959 | Tocci-Guilbert | 51/168 |
| 3,566,547 | 11/1967 | Lonaberger et al. | 51/168 |
| 4,428,120 | 1/1984 | Kobayashi et al. | 83/666 |
| 4,455,788 | 6/1984 | Freerks | 51/334 |

FOREIGN PATENT DOCUMENTS

| | | | |
|---|---|---|---|
| 2050216 | 1/1981 | United Kingdom | 51/209 R |

*Primary Examiner*—Roscoe V. Parker

*Attorney, Agent, or Firm*—Ralph L. Marzocco

[57] ABSTRACT

A cutting disk mounting assembly includes opposing end plates with a stub shaft attached to an exterior surface of one end plate. The plates have a first axial bore formed in the interior surface of the one plate and a protruding axial hub formed on the interior surface of the other plate. The hub is sized to fit in the first bore so as to align the plates in a clamping relation with their interior surfaces located adjacent to one another. A second axial bore is formed through the other plate and the axial hub thereon and a third axial bore is formed through the one plate so as to open into the first bore therein. The third bore aligns with the second bore when the hub is fitted in the first bore. Also, the third bore contains threads which threadably interengage with a threaded fastening screw when the latter is applied through the second bore to attach the aligned plates together in the clamping relation with respect to a cutting disk when the latter is disposed therebetween. The mounting assembly employs a pair of resiliently-flexible O-rings for gripping the cutting disk, and has a pair of continuous grooves defined in the interior surfaces of the plates adjacent the peripheral edges thereof. The grooves retain the O-rings such that they project from the grooves and beyond the respective interior surfaces of the plates so as to resiliently engage and grip opposite sides of the cutting disk.

17 Claims, 3 Drawing Figures

10
12
14
16
18
20
22
24
26
28
30
32
34
36
38
40
42
44
46
48
50
52
54
56
58
60
58(60)
30(32)
34(36)
26(28)
14(16)

CUTTING DISK MOUNTING ASSEMBLY

BACKGROUND OF THE INVENTION

1. Field of the Invention

The present invention relates generally to mounting and clamping a cutting disk, blade or wheel to an arbor and, more particularly, is concerned with a mounting assembly which employs a pair of flexible endless members in the form of rubber O-rings to apply a uniform resilient grip on opposite sides of a cutting disk with the O-rings seated in continuous grooves formed in a pair of end plates being disposed on opposite sides of the cutting disk and clamping the disk therebetween.

2. Description of the Prior Art

Various arrangements have been proposed and utilized heretofore to mount and clamp a circular cutting or grinding blade or wheel to a spindle, arbor or shaft. Representative of the prior art are the mounting arrangements disclosed in U.S. Pat. Nos. to Alden et al (566,883), Perks (1,756,259), Gammeter (1,792,083), Metzger (2,540,793), Tocci-Guilbert (3,036,412), Lonaberger et al (3,566,547) and Freerks (4,455,788).

Basically, most of these mounting arrangements employ a pair of opposing plates or flanges mounted in some manner on an arbor or driven shaft with the cutting or grinding blade or wheel disposed therebetween. The flanges are then clamped together by a fastener applied to the outer end of the shaft. Additionally, as exemplified by the Alden et al, Lonaberger et al and Tocci-Guilbert patents, many different types of members are utilized to apply resilient clamping forces on opposite sides of the wheel. While many mounting arrangements of the prior art would appear to operate reasonably well and generally achieve their objectives under the limited range of operating conditions for which they were designed, most seem to embody shortcomings which make them less than an optimum design. For instance, many employ a multitude of parts which have to be aligned and assembled together each time the wheel is replaced. The greater the number of parts used in the mounting assemblies the greater the opportunities for something to breakdown. Thus, the reliability of such mounting assemblies is reduced.

Consequently, a need still exists for a different approach to design of a cutting or grinding disk or wheel mounting assembly. Such approach should make manufacture and assembling of the mounting assembly easier and reduce the number of parts utilized so as to minimize the time required to assemble and disassemble the mounting assembly and improve the structural integrity and reliability thereof.

SUMMARY OF THE INVENTION

The present invention provides a cutting disk mounting assembly designed to satisfy the aforementioned needs. The mounting assembly of the present invention employs a pair of endless flexible members in the form of rubber O-rings to apply a uniform resilient grip on opposite sides of a cutting disk with the O-rings seated in continuous grooves formed in a pair of end plates being disposed on opposite sides of the cutting disk and clamping the disk therebetween. Advantageously, the mounting assembly is front end loadable so that one does not have to release it from the drive mechanism, such as a drill or grinder, in order to change the cutting disk. It is also constructed to be self-aligning and its O-rings generate a uniformly-distributed, resilient gripping force on the disk.

Accordingly, the present invention is directed to a cutting disk mounting assembly, comprising: (a) a pair of opposing end plates having interior surfaces facing toward one another and exterior surfaces facing away from one another; (b) a drive coupling means attached to an exterior surface of one of the plates; (c) first complementary means defined on the interior surfaces of the plates and being matable together to align the plates in a clamping relation with their interior surfaces located adjacent to one another; (d) fastening means; (e) second complementary means defined through the plates and being adapted to receive the fastening means to attach the aligned plates together in the clamping relation with respect to a cutting disk when the latter is disposed therebetween; (f) a pair of resiliently-flexible endless members; and (g) a pair of continous grooves each defined in one of the interior surfaces of the plates and being adapted to receive and retain one of the endless members therein such that the endless members resiliently engage and grip opposite sides of the cutting disk when the disk is disposed between the plates and the latter are disposed in the clamping relation.

More particularly, each endless member has a cross-sectional thickness greater than the depth of each groove such that the endless member projects from the groove and beyond the interior surface of the respective plate. Specifically, the endless members are O-rings having generally circular cross-sectional shapes. Each groove has a generally square cross-sectional shape and is formed in the interior surface of the respective plate adjacent to a peripheral edge of the plate.

Still further, the drive coupling means is a stub shaft and the fastening means is a threaded screw. Further, the first complementary means is a first axial bore formed in the one plate and protruding axial hub formed on the other plate and sized to fit in the bore so as to align the plates in the clamping relation with their interior surfaces located adjacent to one another. The second complementary means includes a second axial bore formed through the other plate and the axial hub thereon and a third axial bore formed through the one plate which opens into the first bore therein and aligns with the second axial bore when the axial hub is fitted in the first axial bore. The third bore is adapted to interengage with the fastening means when the latter is applied through the second axial bore to attach the plates together. Specifically, the third bore in the one plate contains threads which interengage with the threads of the screw.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figures 1, 2, 3:
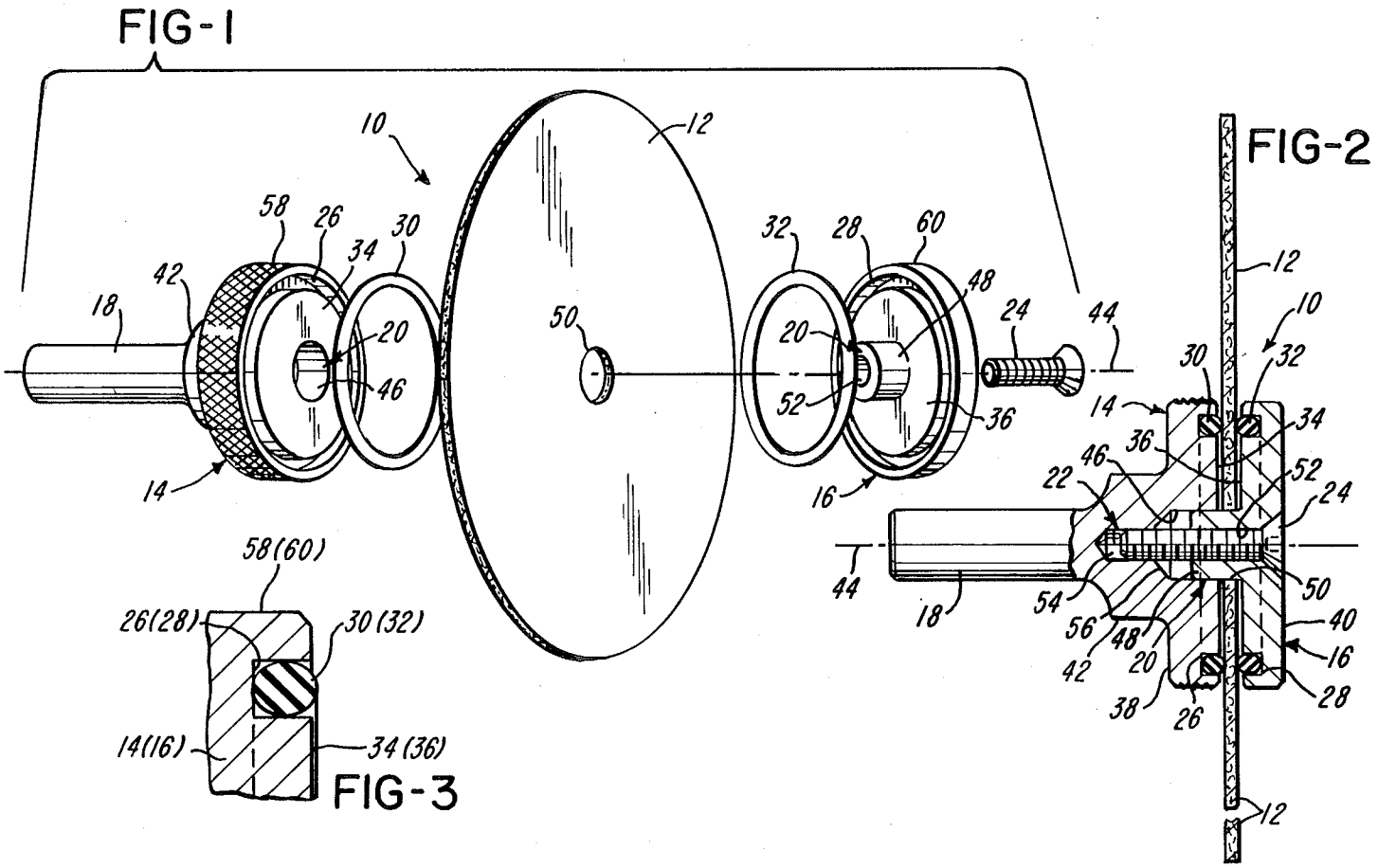
FIG. 1 is an exploded view of the cutting disk mounting assembly of the present invention.
FIG. 2 is an enlarged axial cross-sectional view of the cutting disk mounting assembly of FIG. 1 in assembled form.
FIG. 3 is an enlarged fragmentary cross-sectional view of one of the O-rings seated in its respective groove in one end plate.

In the following description, like reference characters designate like or corresponding parts throughout the several views of the drawings. Also in the following description, it is to be understood that such terms as "forward", "rearward", "left", "right", "upwardly", "downwardly", and the like, are words of convenience and are not to be construed as limiting terms.

Referring now to drawings, and particularly to FIGS. 1 and 2, there is illustrated a cutting disk mounting assembly, generally designated by the numeral 10 and constituting the preferred embodiment of the present invention, being shown disassembled in FIG. 1 and assembled in FIG. 2. While the mounting assembly 10 is particularly adapted to mount and clamp a cutting disk 12 as illustrated in FIGS. 1 and 2, it is possible to use the assembly to mount other types of working tools. In its basic components, the mounting assembly 10 includes a pair of opposing left and right end plates 14 and 16, drive coupling means in the form of a stub shaft 18 on the left end plate 14, first complementary means 20 for aligning the end plates with one another, second complementary means 22 and a fastener 24 for fastening the end plates together, left and right continuous grooves 26 and 28 defined in the respective left and right end plates 14 and 16, and resiliently-flexible endless members in the form of left and right rubber O-rings 30 and 32 for gripping the cutting disk 12.

The left and right end plates 14, 16 are generally cylindrical in shape and have interior surfaces 34, 36 facing toward one another and exterior surfaces 38, 40 facing away from one another. The left end plate 14 includes a generally cylindrical reinforcing shoulder 42 at its exterior surface 38 to which the stub shaft 18 is attached. The shaft 18 extends coaxially with the axis 44 of the mounting assembly 10 which passes through the centers of the end plates 14, 16.

The first complementary means 20 for aligning the end plates 14, 16 with respect to one another are defined on the interior surfaces 34, 36 of the plates and are matable together to align the plates in a clamping relation, such as depicted in FIG. 2, wherein the interior surfaces of the plates are located adjacent to one another. Specifically, the first complementary means 20 includes a first axial bore 46 formed in interior surface 34 of the left plate 14 and a protruding axial hub 48 formed on interior surface 36 of the right plate. The outside diameter and length of the hub 48 are slightly less than the diameter and depth of the first bore 46. The hub 48 is thereby properly sized to snugly fit in the first bore 46 to align the plates 14, 16 in the desired clamping relation with their interior surfaces 34, 36 located adjacent to one another and the O-rings 30, 32 in the grooves 26, 28 thereon establishing a firm grip on the cutting disk 12. The cutting disk 12 has a central aperture 50 allowing passage therethrough of the hub 48 on the right end plate 16.

The second complementary means 22 is adapated to receive the fastener 24 and in conjunction therewith to attach the aligned end plates 14, 16 together in the clamping relation with respect to the cutting disk 10. Specifically, the second complementary means 22 includes a second axial bore 52 formed through the right plate 16 and the axial hub 48 thereon and a third axial bore 54 formed through the left plate 14 which opens into the first bore 46 therein. All of the bores 46, 52 and 54, as well as the hub 48, are cylindrical in shape and disposed coaxial with the axis 44 of the mounting assembly 10 and centers of the end plates 14, 16. The third axial bore 54 in the left plate 14 aligns with the second axial bore 52 in the right plate 16 when the axial hub 48 is fitted in the first axial bore 46. The third bore 54 is approximately the same diameter size as the second axial bore 52, but smaller in diameter than the first bore 46 so as to define an annular shoulder 56 at the transition therebetween. The third bore 54 is also tapped with internal threads adapting it to interengage with threads on the fastener 24 when the latter is applied through second axial bore 52 to attach the plates 14, 16 together. The fastener 24 preferably takes the form of a threaded screw.

The continuous grooves 26, 28 are formed in the respective interior surfaces 34, 36 of the end plates 14, 16 adjacent respective peripheral edges 58 and 60 of the plates. As mentioned earler, each of the grooves 26, 28 are adapted to receive one of the O-rings 30, 32 therein such that the O-ring projects from its respective groove and beyond the respective interior surface of the plate so as to resiliently engage and grip opposite sides of the cutting disk 10 as the plates 14, 16 are placed in the clamping relation to one another. As seen in FIG. 3, each O-ring 30, 32 is generally circular in cross-section and has a cross-sectional thickness (or diameter) which is greater than the depth of each groove such that the O-ring when seated in the groove will project therefrom beyond the interior surface of the respective plate.

The cross-sectional area of each O-ring 30, 32 is also sufficiently greater than that of the respective groove 26, 28 so that the resiliently-flexible O-rings can be compressed as the plates are attached in the clamping relation but the O-rings will still project beyond the interior surfaces of the plates. In such manner, it is the resiliently-flexible O-rings 30, 32 which engage and grip the cutting disk 10 and not the interior surfaces 34, 36 of the end plates 14, 16. It will be understood that while in the illustrated embodiment each groove 26, 28 has a generally square cross-sectional shape, it can have any shape capable of retaining the O-ring therein.

It is thought that the cutting disk mounting assembly of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What is claimed is:

1. A cutting disk mounting assembly, comprising:

(a) a pair of first and second opposing end plates having interior surfaces facing toward one another and exterior surfaces facing away from one another;

(b) drive coupling means attached to said first plate and extending from said exterior surface thereof;

(c) first complementary means defined on said interior surfaces of said plates and being matable together to align said plates in a clamping relation with their interior surfaces located adjacent to one another, said first complementary means including (i) a first axial bore formed in said first plate and opening at said interior surface thereof, and (ii) an axial hub formed on said second plate protruding from said interior surface thereof and being sized to fit in said first axial bore in said first plate so as to align said plates in said clamping relation with their interior surfaces located adjacent to one another and adapted to receive a cutting disk therebetween being inserted over said protruding axial hub of said second plate;

(d) fastening means;

(e) second complementary means defined through said plates and being adapted to receive said fastening means to attach said aligned plates together in said clamping relation with respect to the cutting disk when the latter is disposed between said interior surfaces of said plates and inserted over said protruding axial hub of said second plate;

(f) a pair of resiliently-flexible endless members; and (g) a pair of continuous grooves each defined in one of said interior surfaces of said plates and being adapted to receive and retain one of said endless members therein such that said endless members resiliently engage and grip opposite sides of the cutting disk when the disk is disposed between said plates and the latter are disposed in said clamping relation.

2. The mounting assembly as recited in claim 1, wherein said drive coupling means is a stub shaft.

3. The mounting assembly as recited in claim 1, wherein each endless member has a cross-sectional thickness greater than the depth of each groove such that said member projects from said groove and beyond said interior surface of said respective plate.

4. The mounting assembly as recited in claim 1, wherein each endless member has a generally circular cross-sectional shape.

5. The mounting assembly as recited in claim 1, wherein each groove has a generally square cross-sectional shape.

6. The mounting assembly as recited in claim 1, wherein each groove is formed in said respective interior surface of said plate adjacent to a peripheral edge of said plate.

7. The mounting assembly as recited in claim 1, wherein said endless members are rubber O-rings.

8. The mounting assembly as recited in claim 1, wherein said second complementary means includes a second axial bore formed through said second plate and said axial hub thereon and a third axial bore formed through said first plate which third bore opens into said first bore therein and aligns with said second bore when said axial hub is fitted in said first bore, said third bore having substantially the same diameter size as said second bore and a smaller diameter size than said first bore, said third bore being adapted to receive and interengage with said fastening means when the latter is applied through said second bore to attach said aligned plates together.

9. The mounting assembly as recited in claim 8, wherein said fastening means is a threaded screw and said third bore in said first plate contains threads which interengage with said screw.

10. The mounting assembly as recited in claim 1, wherein said second complementary means includes axial bores formed through said plates, said axial bore in said first plate being adapted to interengage with said fastening means when the latter is applied through said axial bores to attach said plates together.

11. The mounting assembly as recited in claim 10, wherein said fastening means is a threaded screw and said bore in said first plate contains threads which interengage with said screw.

12. A cutting disk mounting assembly, comprising:

(a) a pair of first and second opposing end plates having interior surfaces facing toward one another and exterior surfaces facing away from one another;

(b) a stub shaft attached to said first plate and extending from said exterior surface thereof;

(c) first complementary means defined on said interior surfaces of said plates and being matable together to align said plates in a clamping relation with their interior surfaces located adjacent to one another, said first complementary means including (i) a first axial bore formed in said first plate and opening at said interior surface thereof, and (ii) an axial hub formed on said second plate protruding from said interior surface thereof and being sized to fit in said first axial bore in said first plate so as to align said plates in said clamping relation with their interior surfaces located adjacent to one another and adapted to receive a cutting disk therebetween being inserted over said protruding axial hub of said second plate;

(d) fastening means;

(e) second complementary means defined through said plates and being adapted to receive said fastening means to attach said aligned plates together in said clamping relation with respect to the cutting disk when the latter is disposed between said interior surfaces of said plates and inserted over said protruding axial hub of said second plate, said second complementary means including (i) a second axial bore formed through said second plate and said axial hub thereon, and (ii) a third axial bore formed through said first plate which third bore opens into said first bore therein and aligns with said second bore when said axial hub is fitted in said first bore, said third bore having substantially the same diameter size as said second bore and a smaller diameter size than said first bore, said third bore being adapted to receive and interengage with said fastening means when the latter is applied through said second bore to attach said aligned plates together in said clamping relation with respect to the cutting disk when the latter is disposed therebetween;

(f) a pair of resiliently-flexible O-rings; and (g) a pair of continuous grooves each defined in one of said interior surfaces of said plates and being adapted to receive and retain one of said O-rings therein such that said O-rings resiliently engage and grip opposite sides of the cutting disk when the disk is disposed between said plates and the latter are disposed in said clamping relation.

13. The mounting assembly as recited in claim 12, wherein said fastening means is a threaded screw and said third bore in said first plate contains threads which interengage with said screw.

14. The mounting assembly as recited in claim 12, wherein each O-ring has a cross-sectional thickness greater than the depth of each groove such that said O-ring projects from said groove and beyond said interior surface of said respective plate.

15. The mounting assembly as recited in claim 12, wherein each O-ring has a generally circular cross-sectional shape.

16. The mounting assembly as recited in claim 12, wherein each groove has a generally square cross-sectional shape.

17. The mounting assembly as recited in claim 12, wherein each groove is formed in said respective interior surface of said plate adjacent a peripheral edge of said plate.

* * * * *